US005282442A

United States Patent [19]

Payne

[11] Patent Number: 5,282,442

[45] Date of Patent: Feb. 1, 1994

[54] SPIRAL TUBE WALL FURNACE SEISMIC/WIND TUBE STOP

[75] Inventor: Ronald G. Payne, West Simsbury, Conn.

[73] Assignee: Combustion Engineering, Inc., Windsor, Conn.

[21] Appl. No.: 997,793

[22] Filed: Dec. 29, 1992

[51] Int. Cl.[5] ..... F22B 37/24

[52] U.S. Cl. ..... 122/510; 122/511; 165/82

[58] Field of Search ..... 122/510, 511, 512; 165/82

[56] References Cited

U.S. PATENT DOCUMENTS

| | | | |
|---|---|---|---|
| 4,307,777 | 12/1981 | Chwyla | 122/510 |
| 4,347,810 | 9/1982 | Rees | 122/512 |
| 4,550,777 | 11/1985 | Fournier et al. | 122/510 |
| 5,136,985 | 8/1992 | Krowech | 122/510 |
| 5,207,184 | 5/1993 | Kreider | 122/510 |

*Primary Examiner*—Henry C. Yuen
*Attorney, Agent, or Firm*—Robert S. Smith

[57] ABSTRACT

A tube stop for cooperation with a tube and fin furnace wall and a horizontal buckstay which includes first and second generally parallel generally planar spaced plates, apparatus for attachment of the first and second generally parallel generally planar spaced plates to the associated tube wall. A U-shaped plate has first and second opposed generally planar generally parallel space side walls, the first and second side walls being respectively disposed in spaced relation generally parallel relationship to the first and second generally parallel generally planar spaced plates, apparatus for coupling the first and second walls of the U-shaped member respectively to the first and second generally parallel generally planar spaced plates, and apparatus for rigidly coupling the U-shaped plate to the to the associated horizontal buckstay.

16 Claims, 2 Drawing Sheets

SPIRAL TUBE WALL FURNACE SEISMIC/WIND TUBE STOP

BACKGROUND OF THE INVENTION

The invention relates to vapor generation apparatus generally and more specifically to a tube stop structure used to transmit loading due to seismic disturbances or strong winds that act on such apparatus. Seismic disturbances produce a horizontal load that is a function of the weight of the boiler.

Typical furnace constructions have horizontal buckstays disposed in bands around the perimeter of the furnace tube walls at vertically spaced intervals (often between 15 and 40 feet) throughout the height of the furnace wall. Tube stops are typically disposed between two or three of the horizontal buckstays and the tube wall. Unlike the stirrup connections between the spiral tube wall and the horizontal buckstay the tube stop must transfer a shear load.

While the invention has particular application to furnaces having a spiral tube wall construction. The spiral wall furnace design increases the mass flow per tube by reducing the number of tubes needed to envelop the furnace without increasing the spacing between the tubes. This is done by arranging the tubes at an angle and spiraling them around the furnace. For instance, the number of tubes required to cover the furnace wall can be reduced to one-half by putting the tubes at a 30 degree angle. The angle chosen for the particular application ordinarily will vary between 7 and 30 degrees. An advantage of the spiral wall construction is that every tube is part of all of the wall which means that each tube acts as a heat integrator around the four walls of the combustion chamber.

Conventional tube stop constructions heavy, thick weldments that are welded to the furnace tube walls. Such constructions cause thermal stresses that result in cracking and failure of the furnace tube wall.

Spiral tube wall furnace power boilers are capable of extremely quick changes in power output. These quick changes in power output result in extremely quick changes in the tube wall temperatures. Because of this, apparatus such as the tube stop in accordance with the invention must be designed with particular attention to thermal stress problems.

Another design consideration is field fit-up problems during final assembly. The furnaces to which the present invention has particular application are partially assembled in a shop and then final assembly is completed at a job site. Because of the relatively large size of the apparatus tolerance build-up problems are particularly acute.

SUMMARY OF THE INVENTION

It is an object of the present invention to reduce or eliminate the thermal stress problems that result when the boiler components change temperature quickly or at different rates.

It is another object of the invention to provide apparatus that permits a simplified method of field assembly which substantially eliminates field final assembly fit up problems.

It has now been found that the objects of the invention may be attained in a tube stop for cooperation with a tube and fin furnace wall and a horizontal buckstay which includes first and second generally parallel generally planar spaced plates, means for attachment of the first and second generally parallel generally planar spaced plates to the associated tube wall, and a U-shaped plate having first and second opposed generally planar generally parallel space side walls. The first and second side walls are respectively disposed in spaced relation generally parallel relationship to the first and second generally parallel generally planar spaced plates. The apparatus includes means for coupling the first and second walls of the U-shaped member respectively to the first and second generally parallel generally planar spaced plates, and means for rigidly coupling the U-shaped plate to the to the associated horizontal buckstay.

The means for coupling the first and second walls of the U-shaped member respectively to the first and second generally parallel generally planar spaced plates may allow relative movement of about 0.020". The means for coupling the first and second walls of the U-shaped member respectively to the first and second generally parallel generally planar spaced plates may include a plurality of bolts and nuts.

In some forms of the invention the associated tube wall is a spiral tube wall having a plurality of axial sections of tube coupled respectively by fins and the means for attachment of the first and second generally parallel generally planar spaced plates to the associated tube wall includes a plurality of inserts disposed intermediate laterally adjacent tubes and having the outer face thereof disposed in generally tangential relationship to the tubes and the first and second generally parallel generally planar spaced plates are welded to a plurality of the inserts and the tubes of the tube wall. Each of the inserts may have the axial extremities thereof tapered.

The means for rigidly coupling the U-shaped plate to the associated horizontal buckstay may include a first generally vertical plate that is generally perpendicular to the first and second generally parallel generally planar spaced plates. This means may also include a first and/or a second generally horizontal plate that is generally parallel to the first and second generally parallel generally planar spaced plates and is welded to the generally vertical plate. The first and second plates may be disposed in substantially coplanar relationship. Shims may be carried on the bolts.

In some embodiment of the invention the associated tube wall is a vertical tube wall and the first and second generally parallel generally planar spaced plates are scalloped plates that are welded to the vertical tubes thereof.

BRIEF DESCRIPTION OF THE DRAWING

The invention will be better understood by reference to the accompanying drawing in which.

DESCRIPTION OF THE PREFERRED EMBODIMENT

Figure 1:
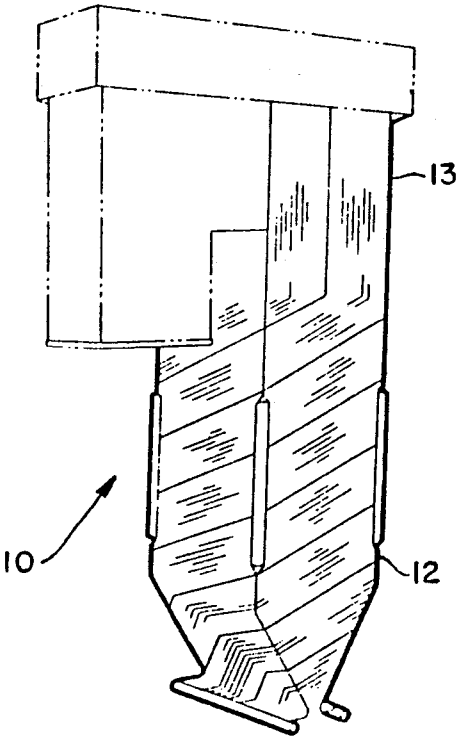
FIG. 1 is a simplified schematic view illustrating a furnace having a spiral tube wall.
Figure 2:
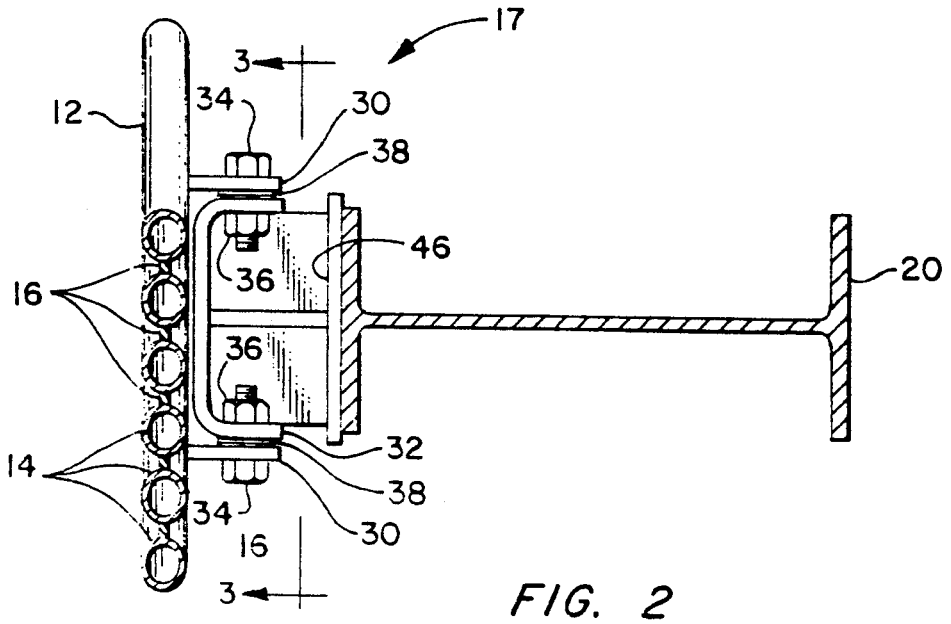
FIG. 2 is a side elevational view of a horizontal buckstay in accordance with one form of the invention.

Referring now to FIG. 1 there is shown a furnace 10 that has a spiral tube wall 12 that comprises a plurality of axial sections of tube 14 coupled by respective fin 16. In the customary manner the upper portions have vertical tubes 13.

Figure 5:
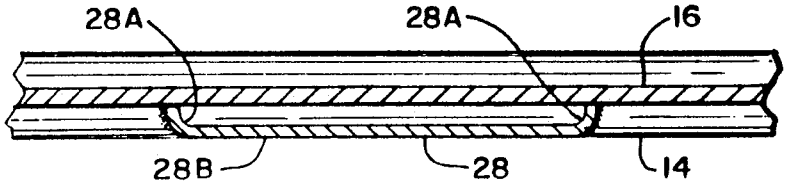
FIG. 5 is a sectional view taken along the line 5—5 of FIG. 4.
Figure 6:
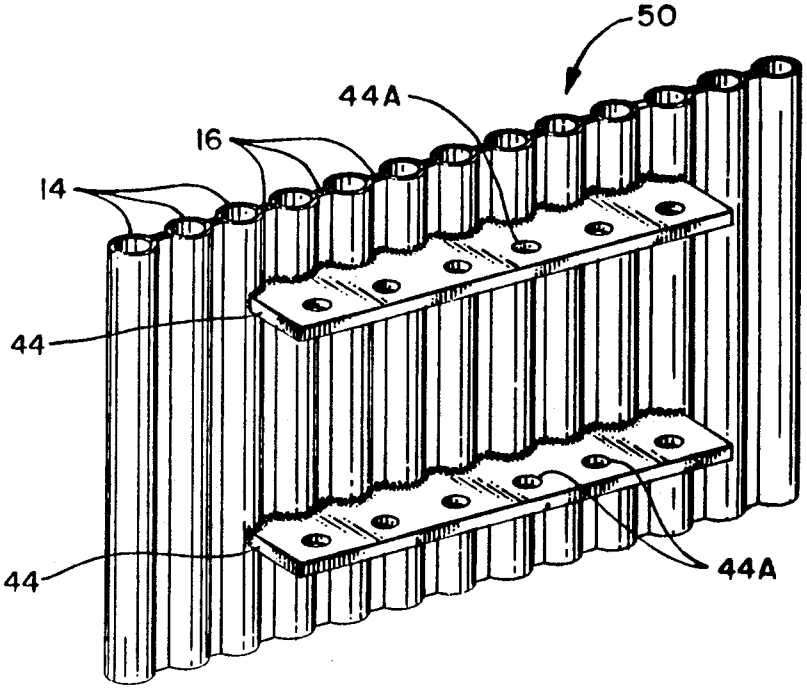
FIG. 6 is a perspective view of another form of the mounting bars in accordance with the invention mounted on a vertical tube furnace wall.
Figure 4:
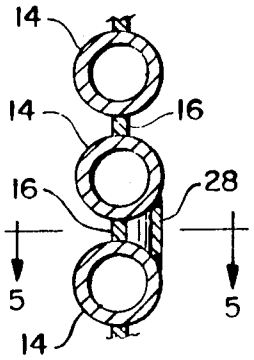
FIG. 4 is a sectional view on insert welded between two adjacent tubes taken along the line 4—4 of FIG. 3.
Figure 3:
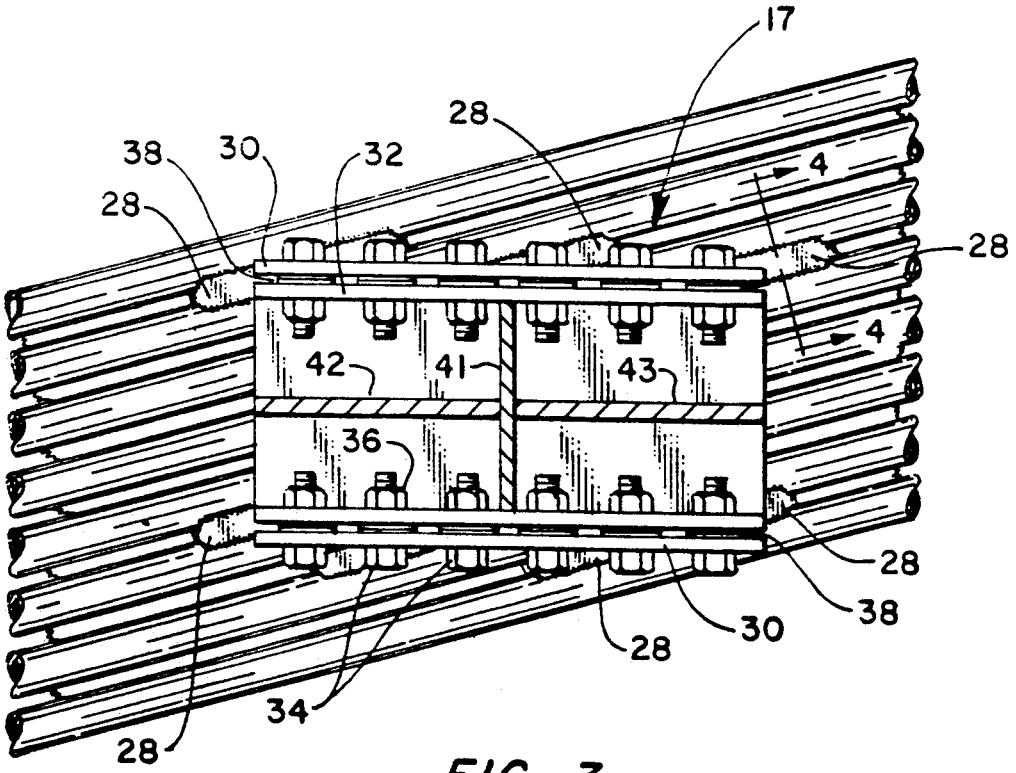
FIG. 3 is a front elevation sectional view taken along the line 3—3 of FIG. 2.

The tube stop assembly 17 in accordance with one form of the invention is shown in FIGS. 2–5. Seismic and wind loads are transmitted from the spiral tube wall 12 into the horizontal buckstay 20 by means of the tube stop assembly 17. As best seen in FIGS. 3–5 inserts 28 that are elongated and have axial extremities 28A that are rounded as best shown in FIG. 5. The axial extremities 28A are also tapered (progressively more pointed), as best seen in FIG. 3, to fit within the axial sections of tube 14. The face 28B thereof is generally planar and disposed in tangential relationship to the axial sections of tube 14. The shape of the inserts 28 is somewhat reminiscent of the shape of devices know colloquially as "church keys" intended for opening cans of beer.

It will thus be seen that the placement of a plurality of the inserts 28 in a generally horizontal grouping provides a mounting surface for two generally horizontal spaced parallel mounting bars 30. The welds mounting the mounting bars 30 on the spiral tube wall 12 and the inserts 28 are thus substantially continuous weld on each side of each mounting bar 30. This results in a mounting that is far superior to merely laying the mounting bar 30 on the spiral tube wall 12 and welding only the locations that are tangent to the surface of the axial sections of tube 14.

To minimize thermal stresses resulting the mounting bars 30 have a minimum reasonable thickness consistent with the forces anticipated for a specific application. The minimum thickness is necessary to maintain the respective mounting bars 30 at a temperature as close as possible to the same temperature as the spiral tube wall 12.

Because the rest of the tube stop 17 is a large thermal mass and reacts slowly to temperature of the spiral tube wall 12 it is highly desirable to provide substantial thermal isolation from the mounting bars 30. Accordingly the mounting bars 30 are connected by a plurality of bolts 34 and nuts 36 to a U-shaped plate 32. The connection also includes shims 38 disposed on the respective bolts 34. The shims 38 reduce heat transfer and simplify field assembly.

The U-shaped plate 32 is dimensioned and configured to be spaced from the spiral tube wall 12 to provide thermal isolation. The connection between the horizontal buckstay 20 and the U-shaped plate 32 is accomplished with vertical plate 41 and first and second coplanar horizontal plates 42, 43. It will be seen that the vertical plate 41 is perpendicular to the coplanar plates 42, 43. The horizontal plate 43 is welded to the vertical plate 41 as is the horizontal plate 42. Each of the plates is welded to the U-shaped plate 32 and also to a planar plate 46. The planar plate 46 is welded to the horizontal buckstay 20. It thus be seen that this substantial weldment will have a large thermal mass and thus the desirability of thermal isolation from the mounting bar 30.

It will be understood that the spaces between (1) the respective mounting bars 30 and the U-shaped plate 32 and (2) the U-shaped plate 32 and the spiral tube wall 12 are important to provide thermal isolation and also to provide field adjustability and fit-up.

The use of bolt rather than welds between the mounting bar 30 and the U-shaped plate 32 is important because it not only reduces heat transfer but also allows a small amount of relative movement. While the relative movement may be as small as 0.020" it will be understood by those skilled in the art that a welded connection could easily crack under similar loading.

In another embodiment of the invention a vertical tube wall 50 comprising vertical axial sections of tube 14 connected by respective fins 16 has planar parallel spaced scalloped plates 44 welded to the wall 50. The scalloped plates 44 are provides with holes 44A for receiving the bolts 34 and the rest of the apparatus disposed between the mounting bars 30 in the other embodiment. Thus the advantages of the invention may be achieved in a furnace having a vertical wall 50.

The invention provides good field adjustability and a structure that does not introduce excessive thermal stresses in the tube wall 12 or the tube stop 17. More particularly, the invention is applicable to both spiral tube and vertical tube furnace walls.

The invention has been described with reference to its illustrate preferred embodiment. Persons skilled in the art of such devices may upon exposure to the teachings herein, conceive other variations. Such variations are deemed to be encompassed by the disclosure, the invention being delimited only by the following claims.

Having thus described my invention I claim:

1. A tube stop for cooperation with a tube and fin furnace wall and a horizontal buckstay which comprises:

first and second generally parallel generally planar spaced plates;

means for attachment of said first and second generally parallel generally planar spaced plates to the associated tube wall;

a U-shaped plate having first and second opposed generally planar generally parallel space side walls, said first and second side walls being respectively disposed in spaced relation generally parallel relationship to said first and second generally parallel generally planar spaced plates;

means for coupling said first and second walls of said U-shaped member respectively to said first and second generally parallel generally planar spaced plates; and means for rigidly coupling said U-shaped plate to said to the associated horizontal buckstay.

2. The apparatus as described in claim 1 wherein:

said means for coupling said first and second walls of said U-shaped member respectively to said first and second generally parallel generally planar spaced plates allows relative movement of about 0.020".

3. The apparatus as described in claim 2 wherein:

said means for coupling said first and second walls of said U-shaped member respectively to said first and second generally parallel generally planar spaced plates comprises a plurality of bolts and nuts.

4. The apparatus as described in claim 3 wherein:

said associated tube wall is a spiral tube wall having a plurality of axial sections of tube coupled respectively by fins and said means for attachment of said first and second generally parallel generally planar spaced plates to the associated tube wall includes a plurality of inserts disposed intermediate laterally adjacent tubes and having the outer face thereof disposed in generally tangential relationship to the tubes and said first and second generally parallel generally planar spaced plates are welded to a plurality of said inserts and the tubes of the tube wall.

5. The apparatus as described in claim 1 wherein:

said associated tube wall is a spiral tube wall having a plurality of axial sections of tube coupled respectively by fins and said means for attachment of said first and second generally parallel generally planar spaced plates to the associated tube wall includes a plurality of inserts disposed intermediate laterally adjacent tubes and having the outer face thereof disposed in generally tangential relationship to the tubes and said first and second generally parallel generally planar spaced plates are welded to a plurality of said inserts and the tubes of the tube wall.

6. The apparatus as described in claim 2 wherein:

said associated tube wall is a spiral tube wall having a plurality of axial sections of tube coupled respectively by fins and said means for attachment of said first and second generally parallel generally planar spaced plates to the associated tube wall includes a plurality of inserts disposed intermediate laterally adjacent tubes and having the outer face thereof disposed in generally tangential relationship to the tubes and said first and second generally parallel generally planar spaced plates are welded to a plurality of said inserts and the tubes of the tube wall.

7. The apparatus as described in claim 3 wherein:

said associated tube wall is a spiral tube wall having a plurality of axial sections of tube coupled respectively by fins and said means for attachment of said first and second generally parallel generally planar spaced plates to the associated tube wall includes a plurality of inserts disposed intermediate laterally adjacent tubes and having the outer face thereof disposed in generally tangential relationship to the tubes and said first and second generally parallel generally planar spaced plates are welded to a plurality of said inserts and the tubes of the tube wall, said inserts being generally planar and having the axial extremities curved for engagement with the associated tube wall.

8. The apparatus as described in claim 7 wherein:

each of said inserts has the axial extremities thereof tapered.

9. The apparatus as described in claim 8 wherein:

said means for rigidly coupling said U-shaped plate to said to the associated horizontal buckstay includes a first generally vertical plate that is generally perpendicular to said first and second generally parallel generally planar spaced plates.

10. The apparatus as described in claim 9 wherein:

said means for rigidly coupling said U-shaped plate to the associated horizontal buckstay includes a first generally horizontal plate that is generally parallel to said first and second generally parallel generally planar spaced plates and is welded to said generally vertical plate.

11. The apparatus as described in claim 10 wherein:

said means for rigidly coupling said U-shaped plate to said to the associated horizontal buckstay includes a second generally horizontal plate that is generally parallel to said first and second generally parallel generally planar spaced plates and is welded to said generally vertical plate.

12. The apparatus as described in claim 11 wherein:

said first and second plates are disposed in substantially coplanar relationship.

13. The apparatus as described in claim 12 wherein:

said apparatus further includes shims on said bolts.

14. The apparatus as described in claim 1 wherein:

the associated tube wall is a vertical tube wall and said first and second generally parallel generally planar spaced plates are scalloped plates that are welded to the vertical tubes thereof.

15. The apparatus as described in claim 2 wherein:

the associated tube wall is a vertical tube wall and said first and second generally parallel generally planar spaced plates are scalloped plates that are welded to the vertical tubes thereof.

16. The apparatus as described in claim 3 wherein:

the associated tube wall is a vertical tube wall and said first and second generally parallel generally planar spaced plates are scalloped plates that are welded to the vertical tubes thereof.

* * * * *